US010861330B2

(12) United States Patent
Sun

(10) Patent No.: US 10,861,330 B2
(45) Date of Patent: Dec. 8, 2020

(54) METHOD AND APPARATUS FOR OBTAINING SIGNAL LIGHT DURATION DATA

(71) Applicant: TENCENT TECHNOLOGY (SHENZHEN) COMPANY LIMITED, Guangdong (CN)

(72) Inventor: Li Guang Sun, Guangdong (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 299 days.

(21) Appl. No.: 15/976,117

(22) Filed: May 10, 2018

(65) Prior Publication Data

US 2018/0261083 A1 Sep. 13, 2018

Related U.S. Application Data

(63) Continuation of application No. PCT/CN2017/083734, filed on May 10, 2017.

(30) Foreign Application Priority Data

May 13, 2016 (CN) ..... 2016 1 0317147

(51) Int. Cl.

| | |
|---|---|
| ***G08G 1/056*** | (2006.01) |
| ***G08G 1/01*** | (2006.01) |
| ***G08G 1/083*** | (2006.01) |

(52) U.S. Cl.

CPC ..... *G08G 1/056* (2013.01); *G08G 1/012* (2013.01); *G08G 1/083* (2013.01)

(58) Field of Classification Search

CPC ..... G08G 1/056; G08G 1/012; G08G 1/083

See application file for complete search history.

(56) References Cited

U.S. PATENT DOCUMENTS

2009/0167561 A1* 7/2009 Liang ..... G08G 1/0104 340/907
2010/0171640 A1* 7/2010 Delia ..... G08G 1/07 340/907

(Continued)

FOREIGN PATENT DOCUMENTS

CN 101577054 A 11/2009
CN 102142197 A 8/2011

(Continued)

OTHER PUBLICATIONS

Notification of Reason for Refusal dated Sep. 20, 2019 from the Korean Intellectual Property Office in application No. 10-2018-7014700.

(Continued)

*Primary Examiner* — Hussein Elchanti
(74) *Attorney, Agent, or Firm* — Sughrue Mion, PLLC

(57) ABSTRACT

A method for obtaining signal light duration data is provided. The method includes obtaining, from running track data of plural positioning terminals, an intersection phase and a set of track sequences that correspond to the intersection phase. A state alternation sequence is obtained from the set of track sequences for the intersection phase. A signal light duration sample value of the intersection phase is obtained from the state alternation sequence, and signal light duration data is generated according to the signal light duration sample value.

20 Claims, 22 Drawing Sheets

(56) References Cited

U.S. PATENT DOCUMENTS

| | | | | |
|---|---|---|---|---|
| 2013/0076538 | A1 | 3/2013 | Uno et al. | |
| 2016/0148507 | A1* | 5/2016 | Pittman | G06Q 30/0255 340/917 |
| 2017/0154525 | A1* | 6/2017 | Zou | G08G 1/08 |
| 2018/0075739 | A1* | 3/2018 | Ginsberg | G08G 1/0133 |
| 2019/0272747 | A1* | 9/2019 | Raamot | G08G 1/0129 |

FOREIGN PATENT DOCUMENTS

| | | | |
|---|---|---|---|
| CN | 104064039 | A | 9/2014 |
| CN | 105976062 | A | 9/2016 |
| JP | 2009-116508 | A | 5/2009 |
| JP | 2010-008068 | A | 1/2010 |
| JP | 2013-073480 | A | 4/2013 |
| WO | 2013/007075 | A1 | 1/2013 |

OTHER PUBLICATIONS

Communication dated Jul. 3, 2018, from the State Intellectual Property Office of People's Republic of China in counterpart Application No. 201610317147.2.

Written Opinion issued by the International Bureau in corresponding International Application No. PCT/CN2017/083734, dated Jul. 26, 2017.

International Search Report of PCT/CN2017/083734 dated Jul. 26, 2017 [PCT/ISA/210].

Communication dated Jun. 25, 2019 from Japanese Patent Office in counterpart JP Application No. 2018-527864.

English Translation of Written Opinion on the International Searching Patentability for PCT/CN2017/083734 dated Jul. 26, 2017.

* cited by examiner

METHOD AND APPARATUS FOR OBTAINING SIGNAL LIGHT DURATION DATA

CROSS-REFERENCE TO RELATED APPLICATIONS

This application is a continuation of International Patent Application No. PCT/CN2017/083734, filed on May 10, 2017, which claims priority to Chinese Patent Application No. 201610317147.2, entitled "SIGNAL LIGHT DURATION DATA DIGGING METHOD, TRAVEL SERVICE IMPLEMENTATION METHOD, AND APPARATUSES" filed with the Patent Office of China on May 13, 2016, the disclosures of each of which are incorporated by reference herein in their entirety.

BACKGROUND

1. Field

This application relates to the technical field of internet application, and in particular, to a method and apparatus for obtaining signal light duration data.

2. Description of Related Art

Signal light duration in a road way network, as important traffic management information, plays an important role in accurate and reliable implementation of travel services. A complete path or a time period for passing a congested road section may be predicted according to signal light duration data of an intersection in the road way network, to further implement a travel service according to the predicted time period for passing through.

In one aspect, the signal light duration data may be directly obtained by establishing close cooperation with a government traffic management department. However, this method of obtaining the data depends on the degree of the cooperation from the government traffic management department, and there are limitations in both the completeness and timeliness of the data provided by the government traffic management department, and it is often impossible to timely obtain complete and accurate data.

In another aspect, the signal light duration data may be obtained by a positioning running track of a mobile phone or a vehicle. That is, position data may be obtained from the mobile phone or vehicle to generate a running track of the phone or vehicle and a time period for a track point of the running track to stop at an intersection may be estimated from the position data.

However, time estimation performed by using this method has many external restrictions, which further results in a quite large offset in the final calculation result.

SUMMARY

It is an aspect to provide a method and apparatus for obtaining signal light duration data that is capable of obtaining complete and accurate signal light duration data.

It is another aspect to provide a travel service implementation method and apparatus that are capable of providing completeness and accuracy of a duration calculation for travel services while obtaining complete and accurate signal light duration data.

According to an aspect of one or more exemplary embodiments, there is provided a method. The method includes obtaining, from running track data of plural positioning terminals, an intersection phase and a set of track sequences that correspond to the intersection phase. A state alternation sequence is obtained from the set of track sequences for the intersection phase. A signal light duration sample value of the intersection phase is obtained from the state alternation sequence, and signal light duration data is generated according to the signal light duration sample value.

According to other aspects of one or more exemplary embodiments, there is also provided an apparatus and other methods consistent with the method.

BRIEF DESCRIPTION OF THE DRAWINGS

Exemplary embodiments are described below with reference to the accompanying drawings, in which.

DESCRIPTION OF EXEMPLARY EMBODIMENTS

Typical implementations reflecting the features and advantages of this application are described in detail in the following. It should be understood that this application may have various changes based on the different implementations, all of which do not depart from the scope of this application and are intended to be included in the appended claims. Moreover, the description and drawings in this application are essentially used for description only, and are not used for limiting this application.

According to various exemplary embodiments, statistics collection is of an intersection in a road network is performed in respective running track data corresponding to multiple positioning terminals, so as to obtain an intersection phase involved in a running track and a track sequence set corresponding to the intersection phase. For each intersection phase, a dynamic-static state alternation sequence in the track sequence set is obtained, a signal light duration sample value of the intersection phase is obtained according to the dynamic-static state alternation sequence, and signal light duration data is generated according to the signal light duration sample value. The obtained signal light duration sample values are a large quantity of samples calculated based on a huge volume of running track data, and therefore complete and accurate signal light duration data may be finally obtained, thus resolving the problems with the related art methods of obtaining such data.

Figure 1:
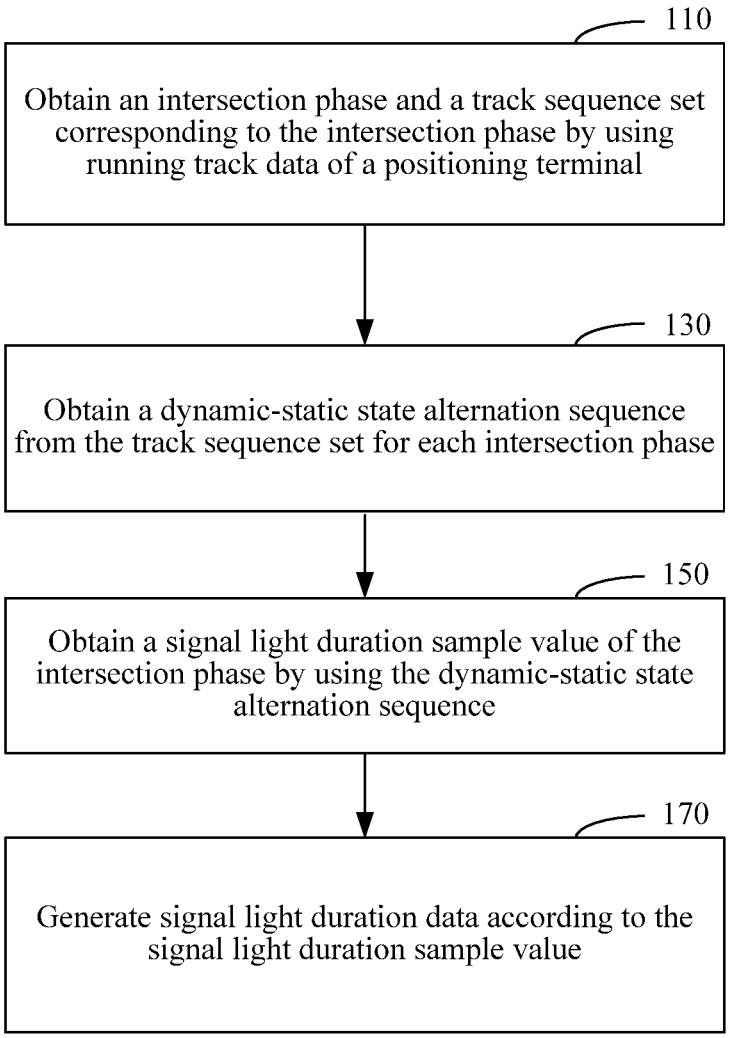
FIG. 1 is a flowchart of a method for obtaining signal light duration data according to an exemplary embodiment.

In an exemplary embodiment, a method for obtaining signal light duration data, as shown in FIG. 1, includes:

Step 110: Obtain an intersection phase and a track sequence set corresponding to the intersection phase by using running track data of a positioning terminal.

A positioning terminal refers to a portable mobile terminal, a vehicle (for example, a vehicle in which a positioning element is mounted), other devices having a positioning capacity (especially outdoor positioning capacity), or the like. During running of the vehicle, or during moving of the portable mobile terminal and other devices having a positioning capacity along with the vehicle, positioning is continuously performed, for example, positioning is performed once per second. Obtained location information (that is, positioning result information) of the location is used as a track point in a running track for each positioning terminal. The positioning terminal sends the positioning result information to a server wirelessly connected to the positioning terminal, and records the positioning result information to the running track data of the positioning terminal, so that the obtained running track data may accurately record the running track.

That is, in a road network, that is, a road network, there are a great number of vehicles that are currently running, and the vehicles or carried mobile devices may be used as positioning terminals. From the above, it may be learned that the obtained running track data is sent by the positioning terminals in the road network to the server, separately, and the running track data of the positioning terminals is used as input data for obtaining the signal light duration data.

The running track data of the positioning terminal corresponds to a running track of the positioning terminal in the road network. Therefore, an intersection through which the positioning terminal passes may be obtained according to the running track data, and further phase statistics collection may be performed for each intersection according to the running track data, to obtain an intersection phase in the running track.

It should be noted that the phase statistics collection refers to generating statistics about intersection phases in a running track according to running track data, to obtain an intersection in the running track and divided intersection phases for each intersection.

The intersection phase may correspond to one or more running directions in an intersection, and each intersection phase has an independent duration. The intersection phase may be obtained through statistics collection of the running track data of the running track in the road network.

For example, for a cross intersection in a road network, if a simplest dual intersection phase control solution is used, an intersection phase 1 may correspond to a running direction of turning left, running straight, and turning around for traffic flows in two directions, namely, the south and the north, and an intersection phase 2 may correspond to a running direction of turning left, running straight, and turning around for traffic flows in two directions, namely, the east and the west. In one section of a time cycle of a signal light, the traffic flows in the south and north directions, i.e., turn left, run straight, and turn around, and in the other section of the time cycle of the signal light, the traffic flows in the east and west directions turn left, run straight, and turn around.

In the process of performing statistics collection of an intersection phase for each intersection in the running track data, a track sequence set of the intersection phase may also be obtained in addition to obtaining the intersection phase.

The track sequence set corresponding to the intersection phase refers to a running track, in the running track data, satisfying the following conditions: entering the intersection where the intersection phase is located, and the running direction in the intersection being a running direction allowed in the intersection phase.

The track sequence set of the intersection phase includes several track sequences, the track sequences are obtained by using the running track data corresponding to the intersection phase. In addition, each track sequence uniquely corresponds to one running track data. The running track data corresponding to the intersection phase refers to running track data of which a corresponding running track in the running track data of the multiple positioning terminals enters the intersection where the intersection phase is located, and the running direction is consistent with a running direction allowed in the intersection phase.

The intersection phase is obtained through statistics collection of the running track data corresponding to the intersection phase, and the track sequence set of the intersection phase is also obtained according to the corresponding running track data.

Step 130: Obtain a dynamic-static state alternation sequence from the track sequence set for each intersection phase.

In the exemplary embodiments of this application, the dynamic-static state alternation sequence is a track sequence in a congestion state. Hence, generation of the signal light duration data implemented subsequently may be obtained based on the dynamic-static state alternation sequence in the congestion state, thereby presenting a stable space-time regularity.

Step 150: Obtain a signal light duration sample value of the intersection phase by using the dynamic-static state alternation sequence.

One day may be divided into multiple time periods, and a signal light duration sample value of an intersection phase may be obtained for one or more time periods.

During phase statistics collection to obtain each intersection phase in the road network, for each intersection phase, the track sequence set of the intersection phase includes a track sequence corresponding to the running track data. Therefore, the track sequence included in the track sequence set also corresponds to a running track existing in the road network.

Therefore, the congestion state existing in the track sequence set may be recognized, and the dynamic-static state alternation sequence may be obtained from the track sequence in the congestion state.

It should be noted that most track sequences in the congestion state have alternate dynamic and static states, that is, corresponding to a situation in which a vehicle actually running in a congestion state moves slowly along with a traffic flow or even stops.

From the above, it may be learned that the dynamic state refers to a state in which a vehicle slowly moves forward along with a traffic flow, during which a stopping state for a short time period may exist, but on the whole the vehicle is continuously moving forward. The static state refers to a state in which a vehicle fully stops for a long period of time (for example, at a light or due to an accident ahead, etc.) in a queue of a traffic flow.

After obtaining, through recognition by using the track sequence set, multiple track sequences in which the congestion state exists, a dynamic-static state alternation sequence of the multiple track sequences in which the congestion state exists is obtained, to further construct a model for each intersection phase by using a dynamic-static state alternation sequence corresponding to the intersection phase, so as to calculate to obtain the signal light duration sample value in time periods of the intersection phase.

The signal light duration data obtained for an intersection phase is used as a large quantity of samples calculated for the intersection phase, for providing data support for subsequent operation. In addition, each time period in the intersection phase corresponds to several signal during sample values among the large quantity of samples.

Step 170: Generate signal light duration data according to the signal light duration sample value.

In the exemplary embodiments of this application, the signal light duration sample values of one or more time periods in a day may be used for generating the signal light duration data, and signal light duration sample distribution may also be considered during generation of the signal light duration data.

After obtaining through calculation the large quantity of signal light duration sample values in time periods of the intersection phase, signal light duration sample value distribution for each intersection phase is obtained, to obtain discreteness of the signal light duration sample value distribution, so as to further obtain signal light duration data adaptive to the signal light duration sample value distribution.

The signal light duration data of the intersection consists of the signal light duration data of the intersection phases. The signal light duration data of the intersection essentially is a time distribution scheme of all the intersection phases, for example, a uniform time distribution scheme the whole day, or a time distribution scheme in time periods, as shown in FIG. 2.

Figure 2:
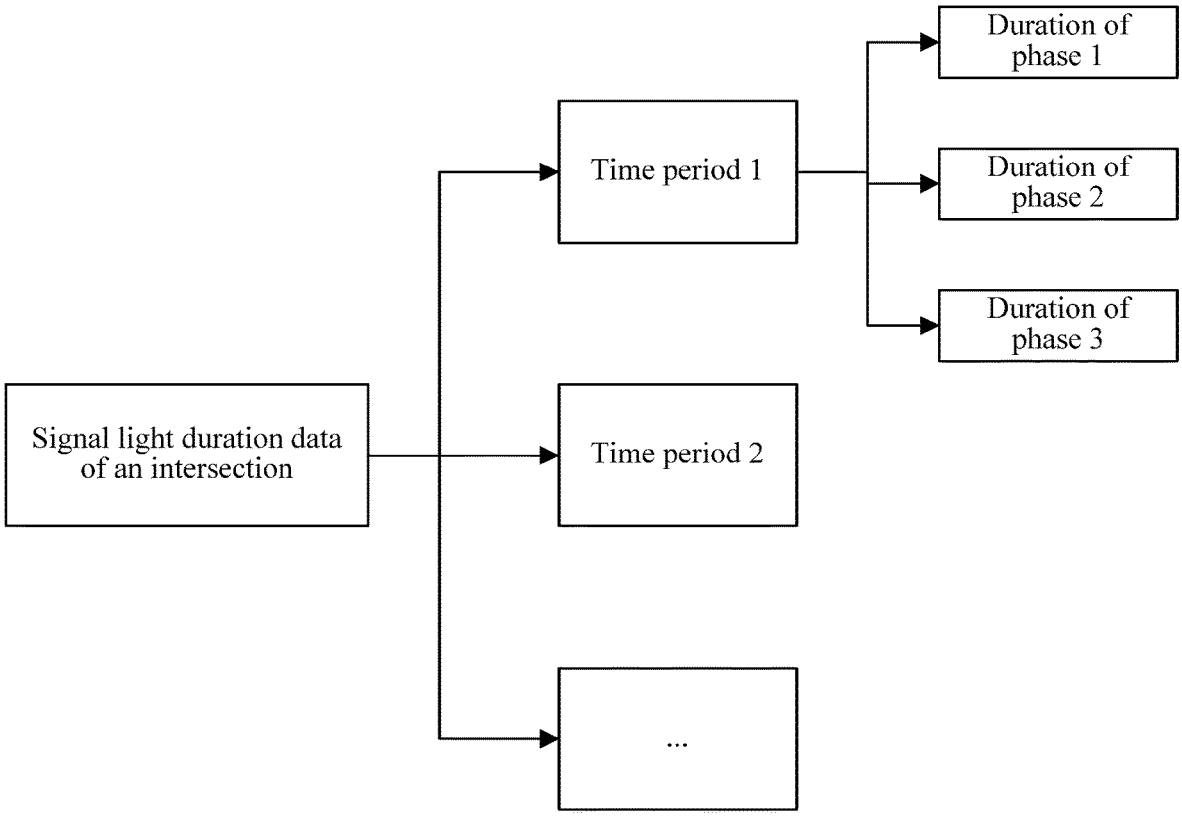
FIG. 2 is a schematic diagram of signal light duration data of an intersection according to an exemplary embodiment.

In the signal light duration data of an intersection shown in FIG. 2, the whole day is divided into multiple time periods, that is, a time period 1, a time period 2, . . . . Signal light duration data of each intersection phase is provided for each time period includes. That is, duration used by each intersection phase in the intersection is configured for each time period.

By the process of obtaining the signal light duration data, the signal light duration sample value for each time period is obtained based on the dynamic-static state alternation sequence in the congestion state, so that generation of the signal light duration data implemented subsequently is obtained based on the dynamic-static state alternation sequence in the congestion state in each time period, thereby presenting a stable space-time regularity.

An example of the process is a process of mining signal light duration data from a congestion track of a vehicle. It is assumed that the vehicle comes across a severe congestion before the intersection. In this case, the vehicle may go through two or more complete signal cycles in the congested traffic flow. In addition, behaviors of the vehicle may be restricted by the congested traffic flow, and therefore a stable space-time regularity is obtained, so that the obtained signal light duration data is complete and accurate data resources, thereby providing high reliability.

A complete path or a time period for passing through the congested road section may be accurately predicted by using the signal light duration data, to further implement a travel service accurately and reliably.

Further, before step 110, the method may further include:

performing positioning by means of a positioning terminal to obtain a track point and record the track point, so as to obtain running track data of the positioning terminal.

A vehicle running in a road network has a positioning function. In one aspect, the vehicle is able to perform positioning and sends positioning result information to a server mining signal light duration data, and the server is able to record the positioning result information to obtain corresponding running track data. In the process, the vehicle is used as the positioning terminal.

In another aspect, a portable mobile terminal and/or other devices having a positioning capacity carried in a vehicle running in an intersection may also be used as the positioning terminal for positioning.

After receiving the positioning result information about positioning performed by the positioning terminal, a track point of the positioning terminal in the running process is obtained according to the positioning result, and further the track point is recorded to running track data of the positioning terminal. The running track data is able to reflect a running track of the positioning terminal.

In the exemplary embodiments of this application, the running track data of the positioning terminal is a record sequence. Each piece of record in the record sequence represents one piece of positioning result information. Specifically, data content included in each record may include: a longitude coordinate, a latitude coordinate, a time stamp, a positioning terminal orientation angle, and an instantaneous point speed.

For example, a time interval for positioning is set in advance, where the time interval may be positioning per second, to obtain a new piece of positioning result information, so as to finally obtain the running track data of the positioning terminal.

By means of the process, a huge volume of running track data is obtained, which covers the whole road network, and a large quantity of running racks in the road network are obtained, to provide a huge quantity of input data for mining of the signal light duration data, thereby guaranteeing completeness and accuracy of mining of the signal light duration data performed by using the method.

Figure 3:
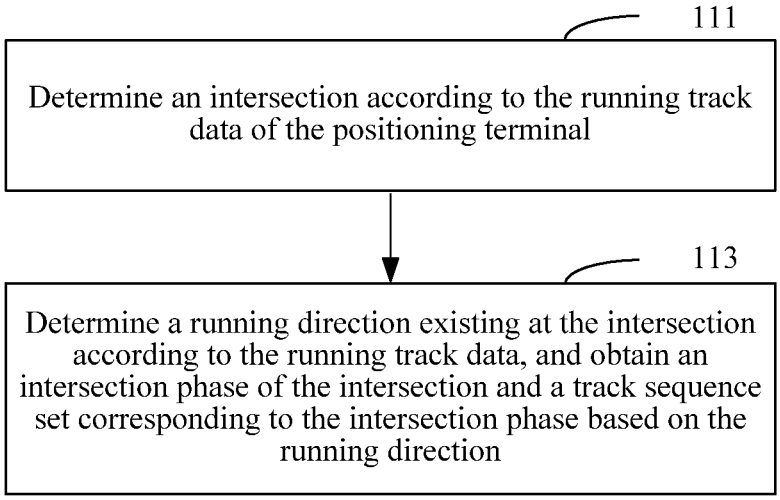
FIG. 3 is a flowchart of a method for obtaining an intersection phase and a track sequence set corresponding to the intersection phase according to running track data of a positioning terminal, according to an exemplary embodiment.

In an exemplary embodiment, as shown in FIG. 3, step 110 may include:

Step 111: Determine an intersection according to the running track data of the positioning terminal.

As described above, the positioning terminals all have running track data. The running track data corresponds to a running track, and therefore, an intersection which the positioning terminal enters during the running (or moving) process may be obtained according to the running track data.

Step 113: Determine a running direction existing at the intersection according to the running track data, and obtain an intersection phase of the intersection and a track sequence set corresponding to the intersection phase based on the running direction.

In the step, the running direction existing at the intersection may be determined separately for one or more time periods of a whole day. Statistics collection and analysis may be performed on the running track data, so as to determine the running direction existing at the intersection in a time period.

In the process of obtaining a corresponding intersection according to running track data, the running track data used for obtaining the intersection corresponds to the intersection. That is, the running track data used for obtaining the intersection is running track data of which a corresponding running track enters the intersection.

For the running track data of which a corresponding running track enters the intersection, the intersection includes two or more intersection phases (different intersection phases allow vehicles in different directions to pass the intersection), and therefore the existing running direction may be obtained through statistics collection from the running track data, so that the intersection phases included in the intersection may be obtained.

In addition, for the intersection phases included in the intersection and obtained through statistics, a corresponding track sequence set is obtained according to the running directions corresponding to the intersection phases. The track sequence set is generated according to the running track data corresponding to the intersection phases.

It should be noted that during obtaining of the intersection phase, statistics collection of the running direction is performed in a same time period, that is, statistics collection about the running direction existing at the intersection in the same time period is performed, so as to guarantee accuracy and timeliness of obtaining of the intersection phase.

By using the process, precise obtaining of an intersection in a road network and an intersection phase in the intersection is implemented based on a huge volume of running track data, to further provide a precise data basis for obtaining of signal light duration data performed subsequently.

In an exemplary embodiment, step 110 may further include:

matching a track point in the running track data to a given road network, to obtain a track sequence, the track sequence recording a road section identifier and a length between a match location of the track point and a road section starting point.

The process is a preprocessing process for the input running track data, for simplifying a subsequent operation process and improving processing efficiency.

A piece of running track data has a running track of a vehicle in a time period and is consistent with a road in a road network. Therefore, the running track data may be matched to a given road network by using a road match algorithm.

A road network includes road sections and also includes a communication relationship between road sections. Therefore, in a specific exemplary embodiment, for each track point in the running track, that is, for each piece of record in the running track data, a location of a road section in the road network where the track point is located is determined, so as to obtain a corresponding match result.

Match results of all pieces of records in the running track data comprise a track sequence. The match result is indicated by a road section identifier (LinkID) and a match location (Pos). A value of the match location is: a length between an optimal match location of the track point in the road section and the road section starting point.

Therefore, the track sequence comprising the match results is conversion of the running track data. The track sequence constructs an association between the running track data and the road network, so as to guarantee simplicity and accuracy of subsequent processing.

Figure 4:
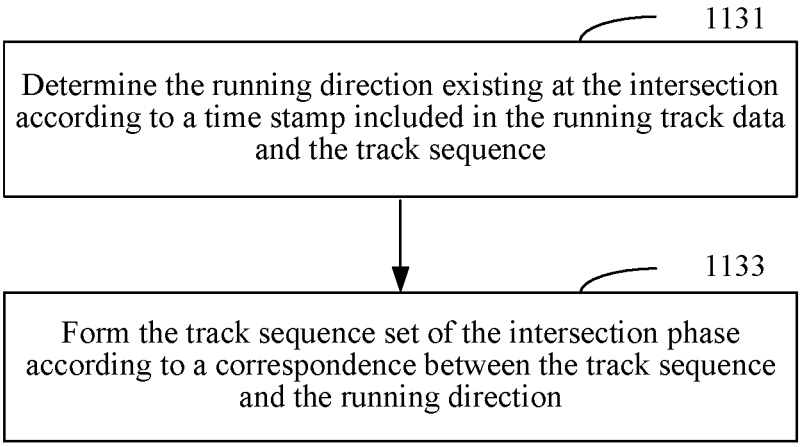
FIG. 4 is a flowchart of a method for determining a running direction existing at an intersection according to running track data, and obtaining an intersection phase divided at the intersection and a track sequence set corresponding to the intersection phase according to the running direction, according to an exemplary embodiment.

In an exemplary embodiment, as shown in FIG. 4, step 113 may include:

Step 1131: Determine the running direction existing at the intersection according to a time stamp included in the running track data and the track sequence.

In the step, the respective running directions existing at all the intersections in the same time period may be obtained through statistics collection according to the time stamp included in the running track data and the track sequence obtained through matching, and the respective divided intersection phases of all the intersections may be obtained according to the running directions.

As described above, each piece of record in the running track data includes the data content of time stamp, and therefore, statistics collection of the running directions of the intersections in the same time period may be performed according to the time stamp and the track sequence in the running track data.

Figure 5:
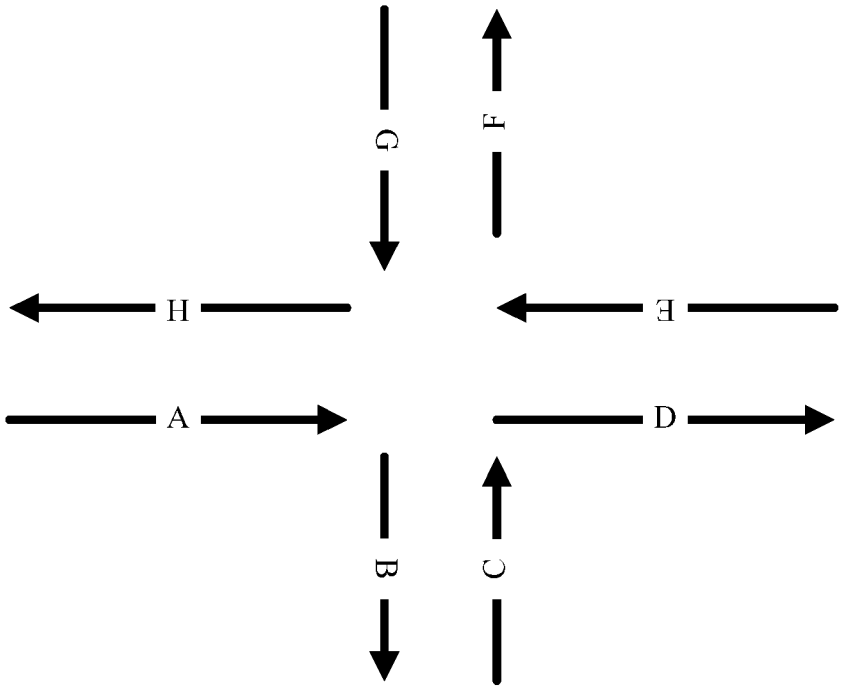
FIG. 5 a schematic diagram of road sections communicating an intersection in a road network according to an exemplary embodiment.

In the road network, front-back combinations of the track sequence in different road sections represent different running directions, that is, traffic flow directions. For example, FIG. 5 shows all road sections communicating an intersection in a road network. A running direction may be obtained according to a front-back combination of two road sections.

That is, the running direction corresponding to A→D is running forward, the running direction corresponding to C→H is turning left, and the running direction corresponding to A→H is turning around.

For a specific intersection, the track sequence representing each running direction is fixed. By performing statistics collection on occurrences of the track sequence is the same time period, the divided intersection phases of the intersection may be determined, and the intersection phase corresponds to an allowed running direction.

Step 1133: Form the track sequence set of the intersection phase according to a correspondence between the track sequence and the running direction.

In the step, the track sequence set of the intersection phase is formed according to the running direction of the track sequence relative to the intersection.

Multiple track sequences representing the corresponding intersection phase are obtained according to the running directions corresponding to the track sequences. The obtained multiple track sequences construct a track sequence set of the intersection phase.

Figure 6:
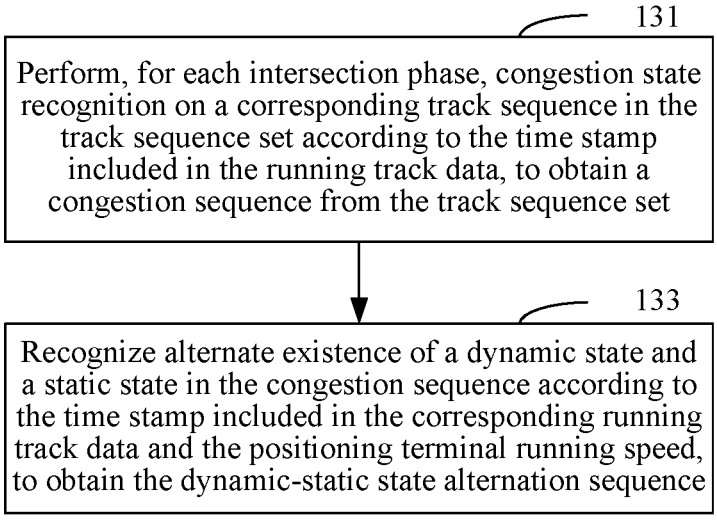
FIG. 6 is a flowchart of a method for obtaining a dynamic-static state alternation sequence from the track sequence set for each intersection phase in the method of FIG. 1, according to an exemplary embodiment.

In an exemplary embodiment, as shown in FIG. 6, step 130 may include:

Step 131: Perform, for each intersection phase, congestion state recognition on a corresponding track sequence in the track sequence set according to the time stamp included in the running track data, to obtain a congestion sequence from the track sequence set.

As described above, on the basis of the given road network, a divided intersection phase of each intersection is obtained through statistics collection. In the track sequence set of the intersection phase, a match result included in each track sequence corresponds to one piece of record in the corresponding running track data, and the data content included in the record at least includes a time stamp.

That is, in the track sequence included in the track sequence set, a time stamp corresponding to each match result may be obtained according to the corresponding running track data. Therefore, in the track sequence set of the intersection phase, congestion state recognition is performed for each track sequence according to a time stamp corresponding to a match result of the track sequence, so as to recognize a track sequence in a congestion state. The track sequence in the congestion state is a congestion sequence.

By the method, all congestion sequences in the track sequence set may be recognized.

In an exemplary embodiment, a determining standard used for performing congestion state recognition according to the time stamp may be: actual travelling duration for passing through the intersection is several times, for example, 3 times or above, greater than default travelling duration for passing. In an alternate exemplary embodiment, if a vehicle corresponding to a track sequence goes through a process of running and stopping multiple times, for example, running at least twice and/or stopping at least twice, or running at least three times and/or stopping at least three times, it may be determined that the track sequence is a congestion sequence.

By the process, screening of the track sequence set is completed, and a track sequence running through any intersection and going through severe congestion is selected.

Step 133: Recognize alternate existence of a dynamic state and a static state in the congestion sequence according to the time stamp included in the corresponding running track data and the positioning terminal running speed, to obtain the dynamic-static state alternation sequence.

The positioning terminal running speed may be an instantaneous point speed corresponding to the time stamp. The instantaneous point speed, as a part of the data content in the running track data, similar to the time stamp, also corresponds to the match result in the track sequence.

After obtaining the congestion sequence corresponding to the intersection phase, a congestion sequence in which the dynamic state and the static state exist alternately may be recognized according to the time stamp and the instantaneous point speed. The congestion sequence is the dynamic-static state alternation sequence.

Specifically, as described above, a congestion sequence corresponds to multiple time stamps and instantaneous point speeds. For each congestion sequence, the congestion sequence is divided into several segments according to the corresponding time stamp and instantaneous point speed, and whether each segment is in the dynamic state or the static state is determined. When the dynamic state and the static state appear alternately, it is determined that the congestion sequence is the dynamic-static state alternation sequence.

Figure 7:
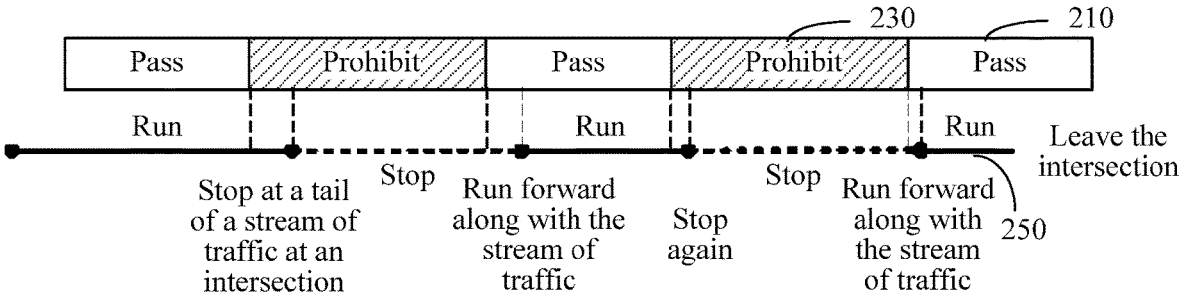
FIG. 7 is a schematic diagram of a relationship between a traffic flow and a phase state according to an exemplary embodiment.

In a process in which a vehicle waiting for passing at an intersection controlled by signal lights, the dynamic state (that is, the running state of the vehicle) or the static state (that is, the stopping state of the vehicle) corresponding to the vehicle corresponds to a state of whether a current phase allows passing. However, a time boundary of the phase state is not strictly aligned with a time boundary of the dynamic-static state of the vehicle. As shown in FIG. 7, there is a delay, and a value of the delay is associated with a distance between the vehicle and the intersection. A short distance with the intersection indicates a small value of the delay, and a long distance with the intersection indicates a large value of the delay. In addition, FIG. 7 also shows that the vehicle goes through multiple times of the dynamic state (that is, the vehicle runs multiple times) and multiple times of the static state (that is, the vehicle stops multiple times).

In the relationship between the traffic flow and the phase state shown in FIG. 7, there is a delay between the dynamic state or static state corresponding to a traffic flow in a road section 250 and a pass state 210 and a prohibit state 230 of the phase state.

In recognition of the dynamic state and the static state performed according to the time stamp and the instantaneous point speed, the feature of the dynamic state is: duration in which successive instantaneous point speeds are continuously 0 is less than a designated threshold, for example, according to experience, the threshold may be set to 10 s; and the features of the static state is: instantaneous point speeds of all track points within a successive time period are all 0.

In an exemplary embodiment, step 170 may include:

obtaining the signal light duration sample value of the intersection phase according to duration and location information of at least one state of the dynamic-static state alternation sequence.

After obtaining the dynamic-static state alternation sequence through recognition, duration and location information of a state in the dynamic state may further be obtained according to the segments of the dynamic state and the segments of the static state that exist alternately in the dynamic-static state alternation sequence.

By the process, a large amount of duration and location information of states may be obtained for the intersection phase, and be used as samples to construct a model. In addition, the signal light duration sample value of the intersection phase may be obtained by performing unknown resolution in the constructed model.

According to the foregoing description, it may be clearly learned that the duration and location information of the states correspond to the time stamps. Therefore, model construction may be performed according to time periods divided in advance to obtain the signal light duration sample value in time periods of the intersection phase.

It should be noted that the time period division is performed for the whole day, but is merely a rough division, for example, the time period division may be performed for the whole day according to experience.

By the process, the obtained signal light duration sample value in the intersection phase is obtained based on a dynamic-static alternate sequence in the congestion state and is a signal light duration sample value in time periods of the intersection phase, and therefore may be obtained through calculation in a most stable space-time regularity while considering various traffic travelling situations that may appear randomly in the whole day. Therefore, the obtained signal light duration sample value may accurately match an actual traffic travelling situation, thereby providing a quite high completeness and accuracy.

Figure 8:
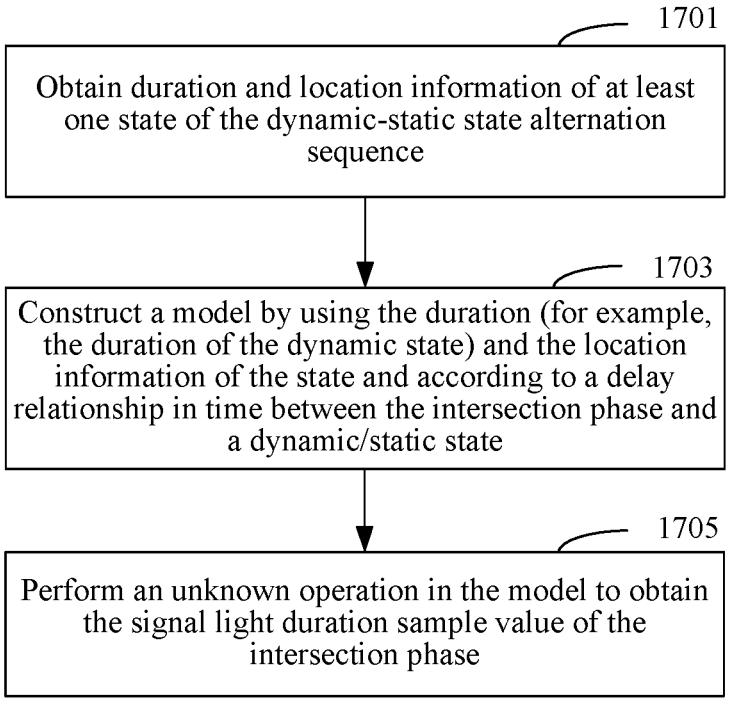
FIG. 8 is a flowchart of a method for obtaining a signal light duration sample value of an intersection phase according to duration and location information of a state of a dynamic-static state alternation sequence according to an exemplary embodiment.

Further, in this exemplary embodiment, as shown in FIG. 8, the step of obtaining the signal light duration sample value of the intersection phase according to duration and location information of at least one state of the dynamic-static state alternation sequence may include:

Step 1701: Obtain duration and location information of at least one state (for example, the dynamic state) of the dynamic-static state alternation sequence.

The step may include obtaining, according to the time periods divided in advance, duration and location information of the dynamic state in the time periods from the dynamic-static state alternation sequence.

The referred location information includes the distance with the intersection when starting and the distance with the intersection when stopping.

Step 1703: Construct a model by using the duration (for example, the duration of the dynamic state) and the location information of the state and according to a delay relationship in time between the intersection phase and a dynamic/static state.

In the exemplary embodiments of this application, a same model may be constructed for different time periods, or different models may be constructed for different time periods.

In an exemplary embodiment, the delay relationship in time between the phase state and the dynamic-static state may be: $Tm=T-L1*a+L2*b$, where Tm denotes duration of a state (for example, duration of the dynamic state once), T denotes a signal light duration sample value to be calculated, L1 denotes the distance with the intersection when starting, L2 denotes the distance with the intersection when stopping, a denotes a delay coefficient when starting, and b denotes a delay coefficient when stopping.

Step 1705: Perform an unknown operation in the model to obtain the signal light duration sample value of the intersection phase.

There are only three unknown numbers in the constructed model, and appropriate values of T, a, and b may be obtained through calculation by obtaining only 3 groups of samples or more than three groups of samples.

In an exemplary embodiment, calculation of the unknown numbers may be implemented by least square fitting.

It should be noted that the obtaining a signal light duration sample value may also be performed in time periods. That is, the whole day may be divided into several time periods of a relatively small interval, to obtain a signal light duration sample value of each time period. For example, the whole day may be divided into 48 time periods with a length of 30 min, and multiple signal light duration sample values may be obtained through calculation corresponding to each time period.

Figure 9:
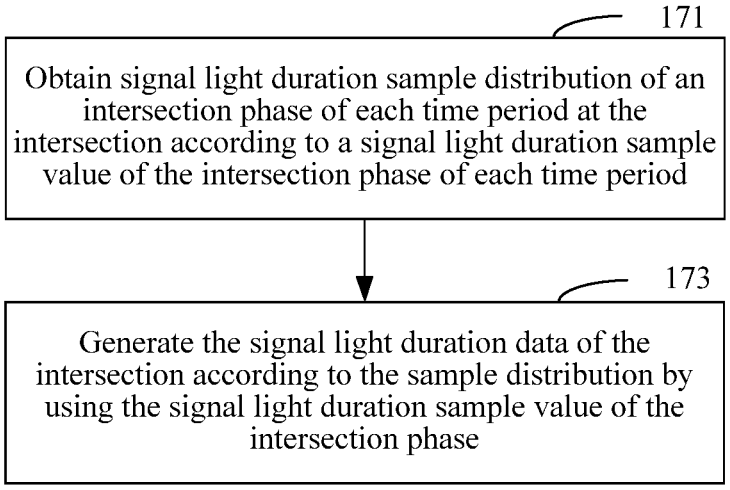
FIG. 9 is a flowchart of a method for generating signal light duration data according to the signal light duration sample value in the method of FIG. 1, according to an exemplary embodiment.

In an exemplary embodiment, as shown in FIG. 9, step 170 may include:

Step 171: Obtain signal light duration sample distribution of an intersection phase of each time period at the intersection according to a signal light duration sample value of the intersection phase of each time period.

By the foregoing process, a large number of signal light duration sample values in each intersection phase in the intersection are obtained. The time period division corresponding to the signal light duration sample values is performed roughly, and therefore, whether the time period division is appropriate is evaluated by using sample distribution formed by the signal light duration sample values in the intersection phase.

Step 173: Generate the signal light duration data of the intersection according to the sample distribution by using the signal light duration sample value of the intersection phase.

Processing is performed on the divided time periods according to the sample distribution for each intersection phase, so as to obtain time division adaptive to the sample distribution.

Further, an average value of the corresponding signal light duration sample values may be calculated according to the finally divided time periods, to obtain the signal light duration data of the intersection phase. The signal light duration data of the intersection phase constructs the signal light duration data of the intersection.

By the foregoing process, the time periods in the signal light duration data may be divided appropriately, to further obtain a signal light time distribution scheme that is consistent with the actual situation.

Figure 10:
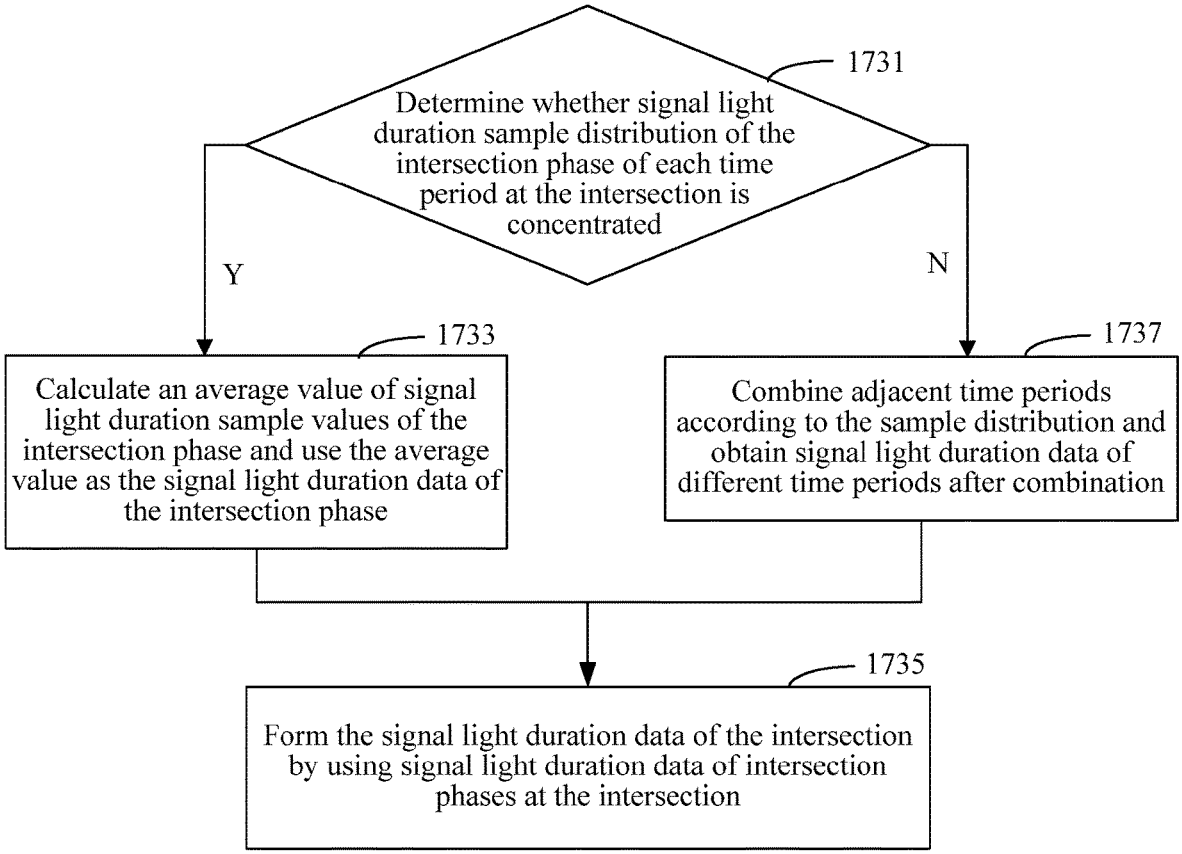
FIG. 10 is a flowchart of a method for generating signal light duration data of an intersection according to sample distribution by using a signal light duration sample value of an intersection phase, according to an exemplary embodiment.

Further, in this exemplary embodiment, as shown in FIG. 10, step 173 may include:

Step 1731: Determine whether signal light duration sample distribution of the intersection phase of each time period at the intersection is concentrated; if yes, perform step 1733, or otherwise, perform step 1737.

If the signal light duration sample distribution is concentrated, time period division is no longer performed. If the signal light duration sample distribution is not concentrated, the time periods are combined according to proximity of the time periods of the signal light duration sample value, so as to finally obtain a large time period division scheme of the whole day.

Therefore, the signal light duration data of the intersection is generated according to the final time period division.

Step 1733: Calculate an average value of signal light duration sample values of the intersection phase and use the average value as the signal light duration data of the intersection phase.

If it is determined that the signal light duration sample distribution of the divided periods of the intersection phase is concentrated, for example, if a relatively concentrated one-peak normal distribution is presented, time period division is no longer performed, and merely a uniform time distribution scheme the whole day may be used.

At this time, an average value of the signal light duration sample values is calculated for each intersection phase, so as to obtain the signal light duration data of the intersection.

Step 1735: Form the signal light duration data of the intersection by using signal light duration data of intersection phases at the intersection.

Step 1737: Combine adjacent time periods according to the signal light duration sample distribution of the intersection phase, and obtain signal light duration data of different time periods after combination.

If it is determined that the signal light duration sample distribution of the divided periods of the intersection phase is not concentrated, for example, if the sample distribution presents an obvious dual-peak or multi-peak normal distribution, the time periods are combined.

Finally, an average value of the signal light duration data for each time period is calculated for the time periods obtained after combination, so as to the signal light duration data in the intersection phase after the time periods are combined.

Figure 11:
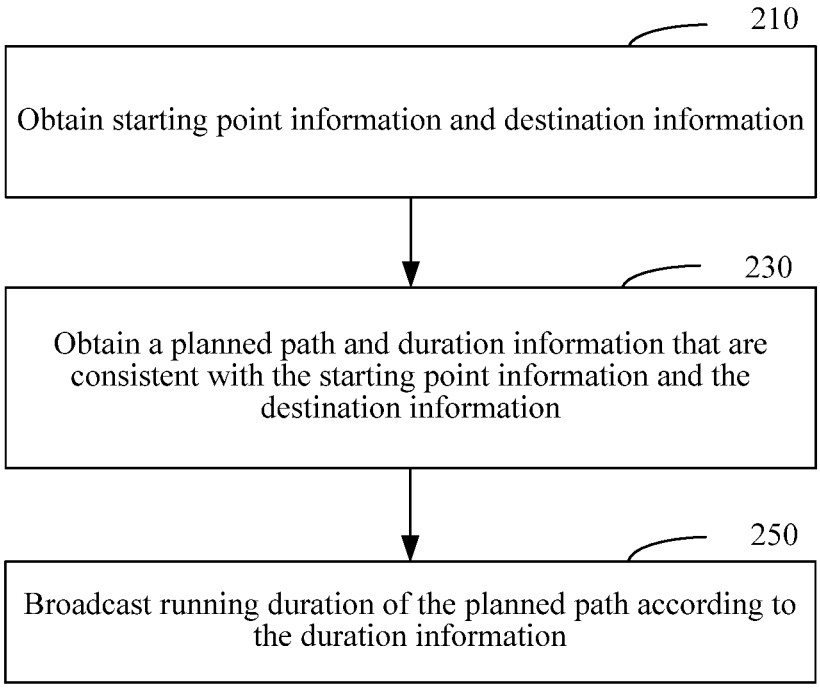
FIG. 11 a flowchart of a travel service implementation method according to an exemplary embodiment.

In addition, a travel service implementation method is further provided correspondingly. As shown in FIG. 11, the method includes:

Step 210: Obtain starting point information and destination information.

Step 230: Obtain a planned path and duration information that are consistent with the starting point information and the destination information.

The duration information includes the signal light duration data of the intersection in the planned path, and the signal light duration data is generated by using the methods according to the above-described exemplary embodiments.

Step 250: Broadcast running duration of the planned path according to the duration information.

By the foregoing travel service implementation method, a travel service implemented at the product side may provide precise running duration for the user, so as to further implement an accurate and reliable travel service.

Figure 12:
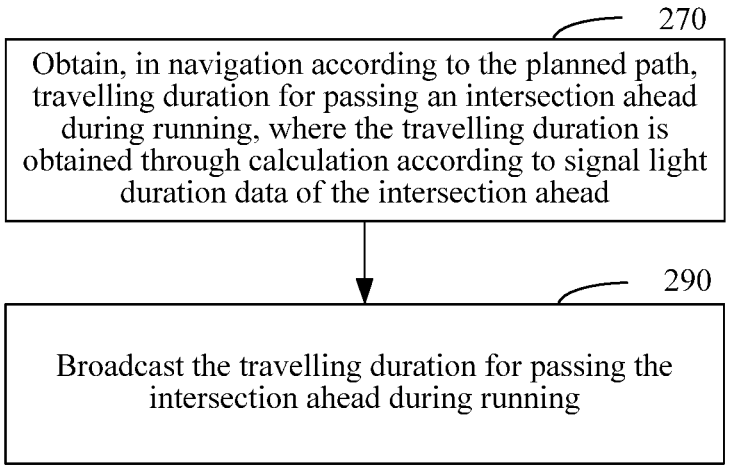
FIG. 12 is a flowchart of a travel service implementation method according to another exemplary embodiment.

Further, in this exemplary embodiment, as shown in FIG. 12, the method may further include:

Step 270: Obtain, in navigation according to the planned path, travelling duration for passing an intersection ahead during running, where the travelling duration is obtained through calculation according to signal light duration data of the intersection ahead.

Step 290: Broadcast the travelling duration for passing the intersection ahead during running.

By the process, time for running through the intersection ahead by the user may be precisely provided in the travel service, to further guarantee precise implementation of the travel service.

Figure 13:
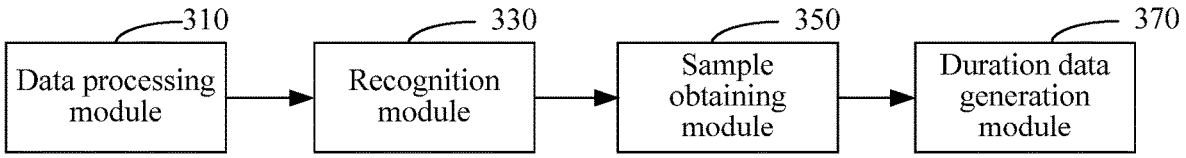
FIG. 13 is a schematic structural diagram of an apparatus for obtaining signal light duration data according to an exemplary embodiment.

In addition, an apparatus for obtaining signal light duration data is also accordingly provided. As shown in FIG. 13, the apparatus includes a data processing module 310, a recognition module 330, a sample obtaining module 350, and a duration data generation module 370, where:

The data processing module 310 is configured to obtain an intersection phase and a track sequence set corresponding to the intersection phase by using running track data of a positioning terminal.

The recognition module 330 is configured to obtain a dynamic-static state alternation sequence from the track sequence set for each intersection phase.

The sample obtaining module 350 is configured to obtain a signal light duration sample value of the intersection phase by using the dynamic-static state alternation sequence.

The duration data generation module 370 is configured to generate signal light duration data according to the signal light duration sample value.

In an exemplary embodiment, the dynamic-static state alternation sequence is a track sequence in a congestion state.

Obtaining a signal light duration sample value of the intersection phase includes:

obtaining the signal light duration sample value of the intersection phase for one or more time periods.

Generating signal light duration data according to the signal light duration sample value includes:

generating signal light duration data of an intersection according to the signal light duration sample value and signal light duration sample distribution.

In an exemplary embodiment, the apparatus may further include a recording module, the recording module is configured to perform positioning by means of a positioning terminal, obtain a track point, and record the track point, to obtain running track data of the positioning terminal.

Figure 14:
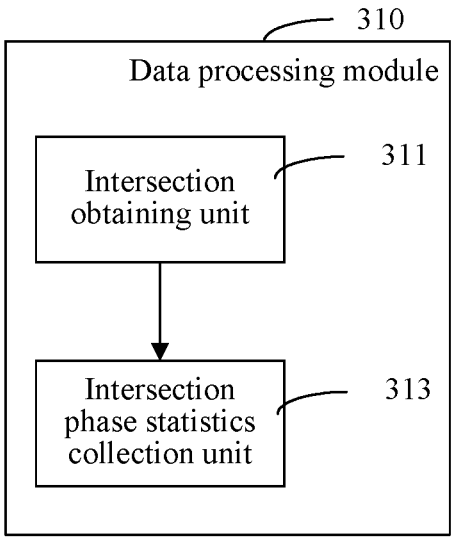
FIG. 14 is a schematic structural diagram of a data processing module of the apparatus of FIG. 13, according to an exemplary embodiment.

In an exemplary embodiment, as shown in FIG. 14, the data processing module 310 may include an intersection obtaining unit 311 and an intersection phase statistics collection unit 313, where:

The intersection obtaining unit 311 is configured to determine an intersection according to the running track data of the positioning terminal.

The intersection phase statistics collection unit 313 is configured to: determine, by using the running track data, a running direction existing at the intersection, and obtain an intersection phase of the intersection and a track sequence set corresponding to the intersection phase based on the running direction.

In another exemplary embodiment, the data processing module 310 may further include a road network matching unit. The road network matching unit is configured to match a track point in the running track data to a given road network, and obtain a track sequence, the track sequence recording a road section identifier and a length between a match location of the track point and a road section starting point.

Figure 15:
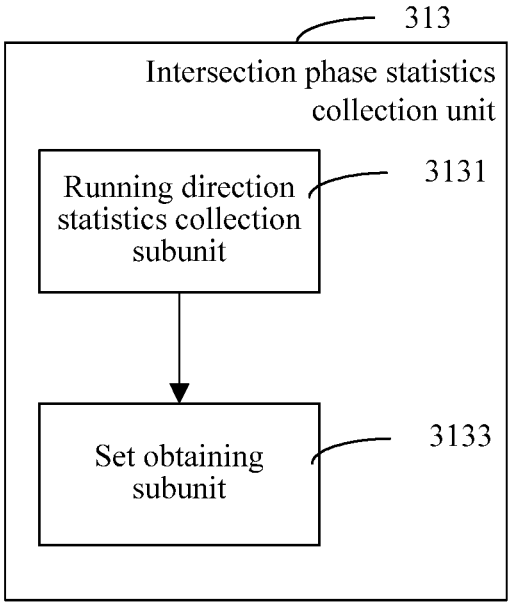
FIG. 15 is a schematic structural diagram of an intersection phase statistics collection unit of the data processing module of FIG. 14, according to an exemplary embodiment.

Further, in this exemplary embodiment, as shown in FIG. 15, the intersection phase statistics collection unit 313 may include a running direction statistics collection subunit 3131 and a set obtaining subunit 3133, where:

The running direction statistics collection subunit 3131 is configured to determine the running direction existing at the intersection according to a time stamp included in the running track data and the track sequence.

The set obtaining subunit 3133 is configured to form the track sequence set of the intersection phase according to a correspondence between the track sequence and the running direction.

Figure 16:
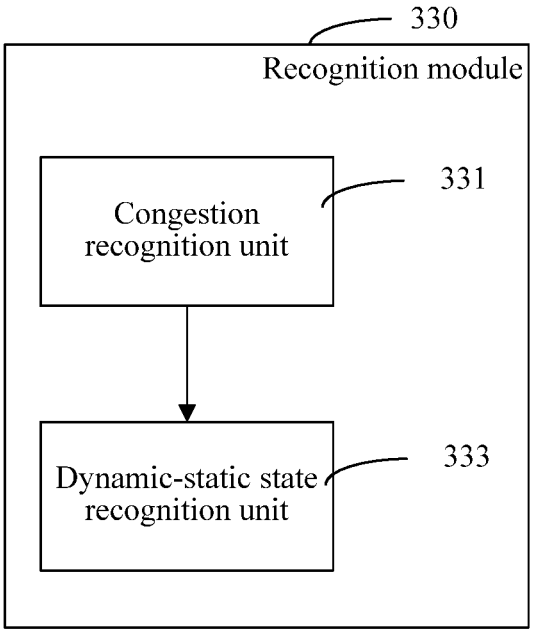
FIG. 16 is a schematic structural diagram of a recognition module of the apparatus of FIG. 13, according to an exemplary embodiment.

In an exemplary embodiment, the running track data may include a time stamp and a positioning terminal running speed corresponding to the time stamp. As shown in FIG. 16, the recognition module 330 may include a congestion recognition unit 331 and a dynamic-static state recognition unit 333, where:

The congestion recognition unit 331 is configured to perform, for each intersection phase, congestion state recognition on a corresponding track sequence in the track sequence set according to the time stamp included in the running track data, to obtain a congestion sequence from the track sequence set.

The dynamic-static state recognition unit 333 is configured to recognize alternate existence of a dynamic state and a static state in the congestion sequence according to the time stamp included in the running track data and the positioning terminal running speed, to obtain the dynamic-static state alternation sequence.

In an exemplary embodiment, the sample obtaining module 350 may be further configured to obtain the signal light duration sample value of the intersection phase according to duration and location information of at least one state of the dynamic-static state alternation sequence.

Figure 17:
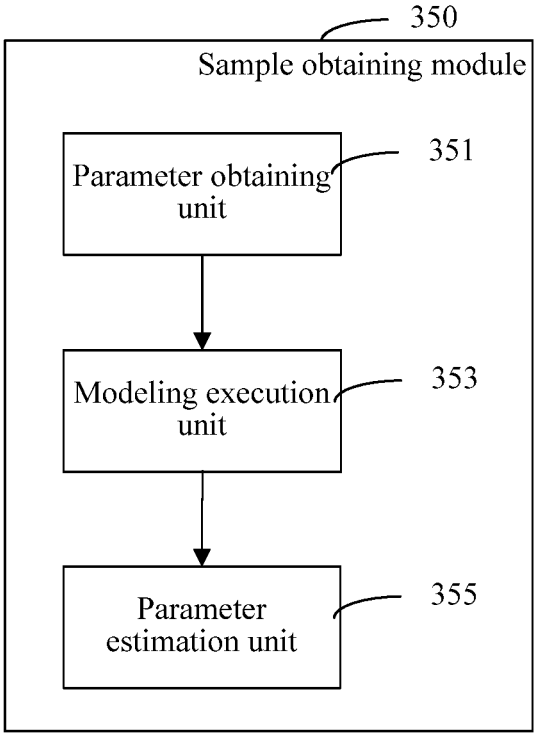
FIG. 17 is a schematic structural diagram of a sample obtaining module of the apparatus of FIG. 13, according to an exemplary embodiment.

Further, in this exemplary embodiment, as shown in FIG. 17, the sample obtaining module 350 may include a parameter obtaining unit 351, a modeling execution unit 353, and a parameter estimation unit 355, where:

The parameter obtaining unit 351 is configured to obtain duration and location information of a dynamic state of the dynamic-static state alternation sequence.

The modeling execution unit 353 is configured to construct a model by using the duration and the location information of the dynamic state and according to a delay relationship in time between the intersection phase and a dynamic/static state.

The parameter estimation unit 355 is configured to perform an unknown operation in the model to obtain the signal light duration sample value of the intersection phase.

Figure 18:
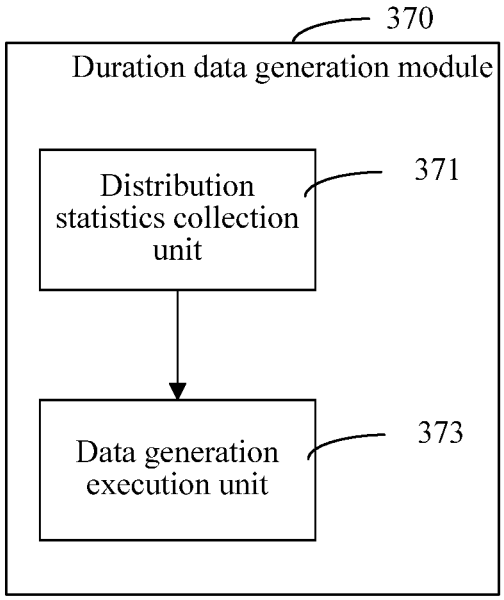
FIG. 18 is a schematic structural diagram of a duration data generation module of the apparatus of FIG. 13, according to an exemplary embodiment.

In an exemplary embodiment, as shown in FIG. 18, the duration data generation module 370 may include a distribution statistics collection unit 371 and a data generation execution unit 373, where:

The distribution statistics collection unit 377 is configured to obtain signal light duration sample distribution of an intersection phase of each time period at the intersection according to a signal light duration sample value of the intersection phase of each time period.

The data generation execution unit 373 is configured to generate the signal light duration data of the intersection according to the sample distribution by using the signal light duration sample value of the intersection phase.

Figure 19:
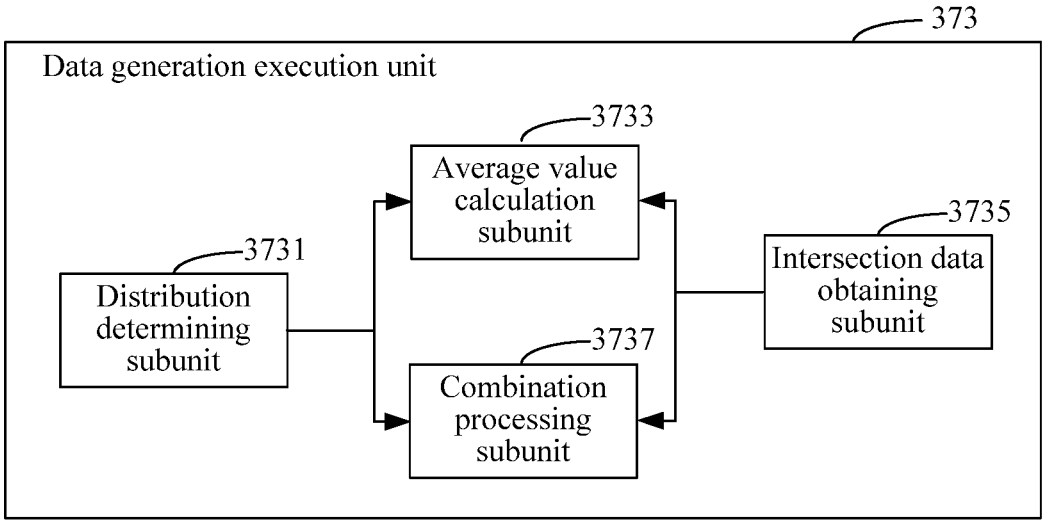
FIG. 19 is a schematic structural diagram of a data generation execution unit of the duration data generation module of FIG. 18, according to an exemplary embodiment.

Further, in this exemplary embodiment, as shown in FIG. 19, the data generation execution unit 373 may include a distribution determining subunit 3731, an average value calculation subunit 3733, an intersection data obtaining subunit 3735, and a combination processing subunit 3737, where:

The distribution determining subunit 3731 is configured to: determine whether signal light duration sample distribution of the intersection phase of each time period at the intersection is concentrated, if yes, notify the average value calculation subunit 3733, and if not, notify the combination processing subunit 3737.

The average value calculation subunit 3733 is configured to calculate an average value of signal light duration sample values of the intersection phase and use the average value as the signal light duration data of the intersection phase.

The intersection data obtaining subunit 3735 is configured to form the signal light duration data of the intersection by using signal light duration data of intersection phases at the intersection.

The combination processing subunit 3737 is configured to combine adjacent time periods according to the sample distribution and obtain signal light duration data of different time periods after combination.

Figure 20:
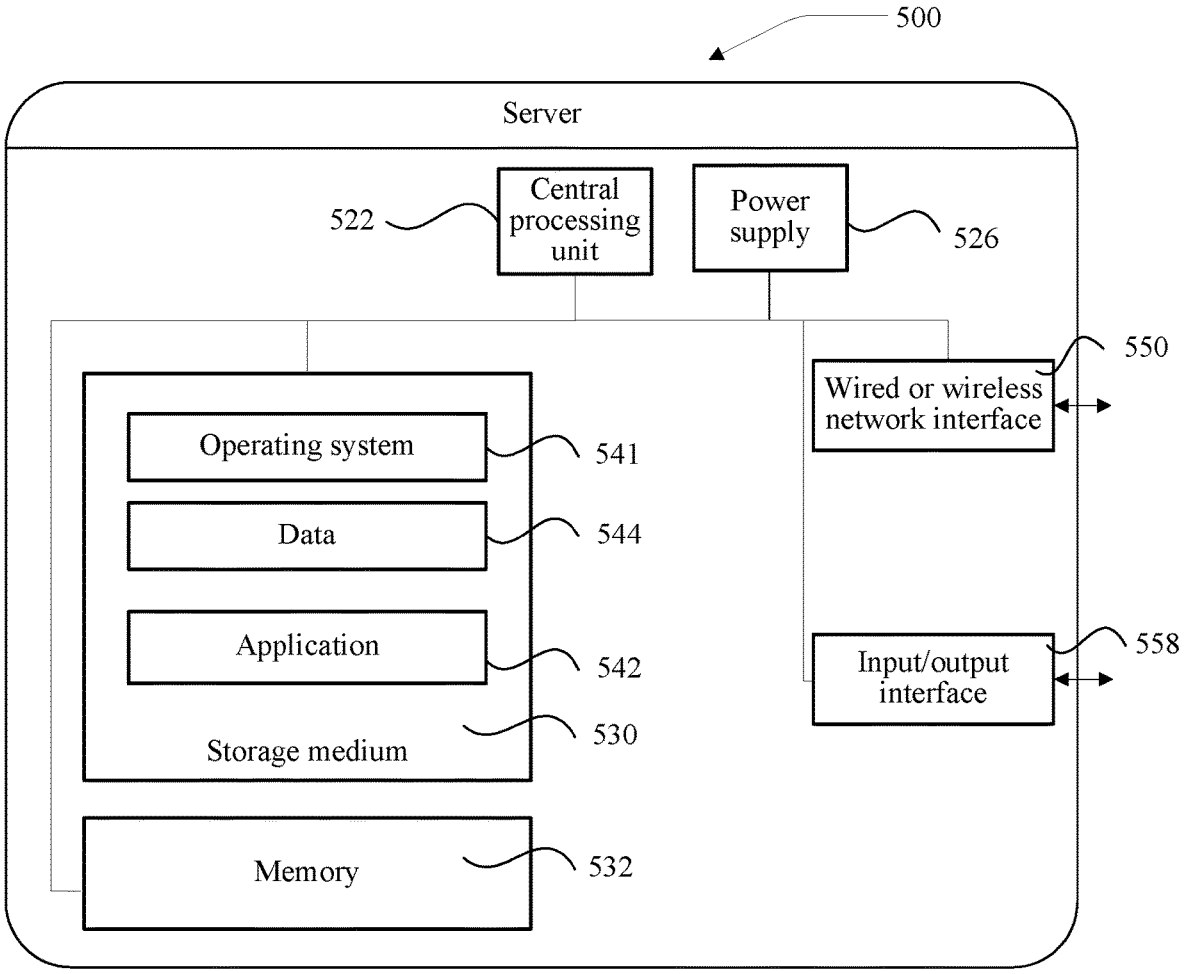
FIG. 20 is a schematic structural diagram of a calculation apparatus according to an exemplary embodiment of this application.

FIG. 20 shows a structure of a calculation apparatus 500 according to an exemplary embodiment of this application. One example of the calculation apparatus is a server. The server 500 may vary greatly due to different configurations or performance, and may include one or more central processing units (CPU) 510 (for example, one or more processors) and a memory 520, and one or more storage media 531 (for example, one or more mass storage devices) that store applications 533 or data 530. The memory 520 and the storage medium 530 may be transient or persistent storages. The program stored in the storage medium 530 may include one or more modules (not shown in the figure), and each module may include a series of instructions and operations for the server. Still further, the CPU 510 may be configured to communicate with the storage medium 530, and perform, on the server 500, a series of instructions and operations in the storage medium 530. The server 500 may further include one or more power supplies 550, one or more wired or wireless network interfaces 570, one or more input/output interfaces 580, and/or one or more operating systems 535, for example, Windows Server™, Mac OS X™, Unix™, Linux™, or FreeBSD™.

In addition, this application may also be implemented by a hardware circuit or a hardware circuit in combination with software instructions. Therefore, this application is not limited any specific hardware circuit, software, or a combination of the hardware circuit and software.

Figure 21:
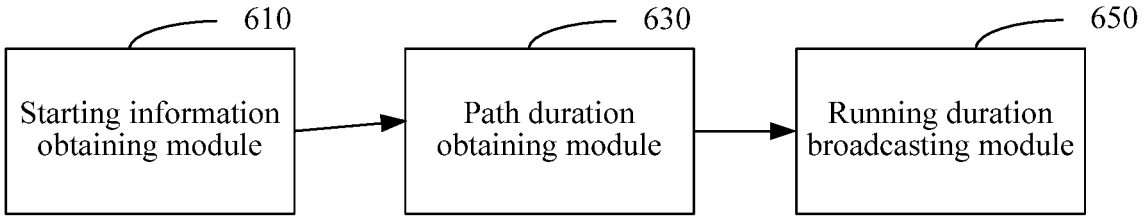
FIG. 21 is a schematic structural diagram of a travel service implementation module according to an exemplary embodiment.

In another exemplary embodiment, as shown in FIG. 21, a travel service implementation apparatus includes: a starting information obtaining module 610, a path duration obtaining module 630, and a running duration broadcasting module 650, where:

The starting information obtaining module 610 is configured to obtain starting point information and destination information.

The path duration obtaining module 630 is configured to obtain a planned path and duration information that are consistent with the starting point information and the destination information, the duration information including signal light duration data of an intersection on the planned path, and the signal light duration data being generated by the apparatus for digging the signal light duration data.

The running duration broadcasting module 650 is configured to broadcast running duration of the planned path according to the duration information.

Figure 22:
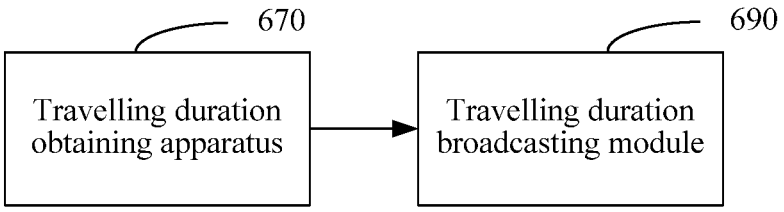
FIG. 22 is a schematic structural diagram of a travel service implementation module according to another exemplary embodiment.

Further, in this exemplary embodiment, as shown in FIG. 22, the apparatus may further include a travelling duration obtaining apparatus 670 and a travelling duration broadcasting module 690, where:

The travelling duration obtaining module 670 is configured to obtain, in navigation according to the planned path, travelling duration for passing an intersection ahead during running, where the travelling duration is obtained through calculation according to signal light duration data of the intersection ahead.

The travelling duration broadcasting module 690 is configured to broadcast the travelling duration for passing the intersection ahead during running.

A person of ordinary skill in the art may understand that all or some of the steps of the foregoing exemplary embodiments may be implemented by using hardware, or may be implemented by a program instructing relevant hardware. The program may be stored in a computer readable storage medium. The storage medium may be a read-only memory, a magnetic disk, an optical disc, or the like.

Although this application is described with reference to some typical implementations, it should be understood that the used terms are descriptive and exemplary terms instead of limitative terms. This application may be specifically implemented in various forms without departing from the spirit or essence of the application, it should be understood that the implementations are not limited to any of the foregoing details, and should be widely interpreted within the spirit and scope defined in the attached claims. Therefore, all changes and modifications falling within the claims or equivalent scope of the claims should be covered by the attached claims.

What is claimed is:

1. A method comprising:

determining, from running track data of a plurality of positioning terminals, an intersection in a road network;

obtaining, from the running track data of the plurality of positioning terminals, an intersection phase of the intersection and a set of track sequences that correspond to the intersection phase;

obtaining a state alternation sequence from the set of track sequences for the intersection phase;

obtaining, from the state alternation sequence, a plurality of signal light duration sample values of the intersection phase; and generating signal light duration data according to the plurality of signal light duration sample values.

2. The method according to claim 1, wherein:

the state alternation sequence is a track sequence in a congestion state among the set of track sequences;

the signal light duration sample values are obtained for one or more time periods; and the signal light duration data is generated according to the signal light duration sample values and a signal light duration sample distribution of the signal light duration sample values.

3. The method according to claim 1, wherein the obtaining the intersection phase comprises:

determining, from the running track data, a running direction existing at the intersection; and obtaining the intersection phase of the intersection and the set of track sequences that correspond to the intersection phase based on the running direction.

4. The method according to claim 3, further comprising obtaining a plurality of track points according to locations of the plurality of positioning terminals, wherein the obtaining the intersection phase comprises:

performing matching on the plurality of track points and a road section of a road network, to obtain a track sequence, wherein the track sequence comprises a road section identifier and a length between a location of the track point in the road section and a road section starting point.

5. The method according to claim 4, wherein the determining the running direction comprises:

determining the running direction existing at the intersection according to a time stamp comprised in the running track data and the track sequence; and the obtaining an intersection phase comprises:

forming the set of track sequences according to a correspondence between the track sequence and the running direction.

6. The method according to claim 1, wherein the running track data comprises a time stamp and a running speed of the positioning terminal that corresponds to the time stamp, wherein the obtaining the state alternation sequence comprises:

performing, for the intersection phase, congestion state recognition on a corresponding track sequence in the set of track sequences according to the time stamp, to obtain a congestion sequence from the set of track sequences; and recognizing alternate existence of a dynamic state and a static state in the congestion sequence according to the time stamp and the running speed, to obtain the state alternation sequence.

7. The method according to claim 1, wherein the signal light duration sample value is obtained according to duration and location information of at least one state of the state alternation sequence.

8. The method according to claim 7, wherein the obtaining the plurality of signal light duration sample values comprises:

obtaining the duration and location information of a dynamic state of the state alternation sequence;

constructing a model according to the duration and the location information of the dynamic state and a time delay between the intersection phase and the dynamic state; and performing an operation in the model to obtain the plurality of signal light duration sample values of the intersection phase.

9. The method according to claim 2, wherein the generating signal light duration data comprises:

obtaining a signal light duration sample distribution of an intersection phase of each time period at the intersection according to the plurality of signal light duration sample values of the intersection phase of each time period; and generating the signal light duration data of the intersection according to the signal light duration sample distribution of the intersection phase.

10. The method according to claim 9, wherein the generating the signal light duration data comprises:

determining whether the signal light duration sample distribution of the intersection phase of each time period at the intersection is concentrated, and in response to the signal light duration sample distribution being concentrated, calculating an average value of the plurality of signal light duration sample values of the intersection phase as the signal light duration data of the intersection phase.

11. An apparatus comprising:

at least one memory configured to store computer program code; and at least one processor configured to access the at least one memory and operate according to the computer program code, the computer program code including:

intersection code configured to cause at least one of the at least one processor to determine, from running track data of a plurality of positioning terminals, an intersection in a road network;

data processing code configured to cause at least one of the at least one processor to obtain, from the running track data of the plurality of positioning terminals, an intersection phase of the intersection and a set of track sequences that correspond to the intersection phase;

recognition code configured to cause at least one of the at least one processor to obtain a state alternation sequence from the set of track sequences set for the intersection phase;

sample obtaining code configured to cause at least one of the at least one processor to obtain, from the state alternation sequence, a plurality of signal light duration sample values of the intersection phase; and duration data generation code configured to cause at least one of the at least one processor to generate signal light duration data according to the plurality of signal light duration sample values.

12. The apparatus according to claim 11, wherein the state alternation sequence is a track sequence in a congestion state among the set of track sequences;

the sample obtaining code is configured to cause at least one of the at least one processor to obtain the plurality of signal light duration sample values for one or more time periods; and the duration data generation code is configured to cause at least one of the at least one processor to:

generate the signal light duration data according to the signal light duration sample values and a signal light duration sample distribution of the signal light duration sample values.

13. The apparatus according to claim 11, wherein the data processing code comprises:

intersection phase statistics collection code configured to cause at least one of the at least one processor to: determine, from the running track data, a running direction existing at the intersection, and obtain the intersection phase of the intersection and the set of track sequences that correspond to the intersection phase based on the running direction.

14. The apparatus according to claim 13, further comprising:

recording code configured to cause at least one of the at least one processor to obtain a plurality of track points according to locations of the plurality of positioning terminals, wherein the data processing code comprises:

road network matching code configured to cause at least one of the at least one processor to perform matching on the plurality of track points and a road section of a road network, to obtain a track sequence, wherein the track sequence comprises a road section identifier and a length between a location of the track point in the road section and a road section starting point.

15. The apparatus according to claim 14, wherein the intersection phase statistics collection code comprises:

running direction statistics collection subcode configured to cause at least one of the at least one processor to determine the running direction existing at the intersection according to a time stamp comprised in the running track data and the track sequence; and set obtaining subcode configured to cause at least one of the at least one processor to form the set of track sequences of the intersection phase according to a correspondence between the track sequence and the running direction.

16. The apparatus according to claim 11, wherein the running track data comprises a time stamp and a running speed of the positioning terminal that corresponds to the time stamp, wherein the recognition code comprises:

congestion recognition code configured to cause at least one of the at least one processor to perform, for the intersection phase, congestion state recognition on a corresponding track sequence in the set of track sequences according to the time stamp, to obtain a congestion sequence from the set of track sequences; and state recognition code configured to cause at least one of the at least one processor to recognize alternate existence of a dynamic state and a static state in the congestion sequence according to the time stamp and the running speed, to obtain the state alternation sequence.

17. The apparatus according to claim 11, wherein the sample obtaining code is further configured to cause at least one of the at least one processor to obtain the signal light duration sample value of the intersection phase according to duration and location information of at least one state of the state alternation sequence.

18. The apparatus according to claim 16, wherein the sample obtaining code comprises:

parameter obtaining code configured to cause at least one of the at least one processor to obtain the duration and location information of a dynamic state of the state alternation sequence;

modeling execution code configured to cause at least one of the at least one processor to construct a model by using the duration and the location information of the dynamic state and according to a time delay between the intersection phase and the dynamic state; and parameter estimation code configured to cause at least one of the at least one processor to perform an operation in the model to obtain the plurality of signal light duration sample values of the intersection phase.

19. The apparatus according to claim 12, wherein the duration data generation code comprises:

distribution statistics collection code configured to cause at least one of the at least one processor to obtain a signal light duration sample distribution of an intersection phase of each time period at the intersection according to a plurality of signal light duration sample values of the intersection phase of each time period; and data generation execution code configured to cause at least one of the at least one processor to generate the signal light duration data of the intersection according to the signal light duration sample distribution of the intersection phase.

20. The apparatus according to claim 19, wherein the data generation execution code comprises distribution determining subcode, average value calculation subcode, and intersection data obtaining subcode, wherein:

the distribution determining subcode configured to cause at least one of the at least one processor to: determine whether the signal light duration sample distribution of the intersection phase of each time period at the intersection is concentrated, and in response to the signal light duration sample distribution being concentrated, the average value calculation subcode configured to cause at least one of the at least one processor to calculate an average value of the plurality of signal light duration sample values of the intersection phase as the signal light duration data of the intersection phase; and the intersection data obtaining subcode configured to cause at least one of the at least one processor to form the signal light duration data of the intersection from the signal light duration data of intersection phases at the intersection.

* * * * *